United States Patent [19]

Höefer et al.

[11] 4,176,685

[45] Dec. 4, 1979

[54] VALVE ARRANGEMENT FOR CONTROLLING THE FLOW OF HYDRAULIC FLUID TO AND FROM A USER

[75] Inventors: Friedrich-Wilhelm Höefer, Ditzingen; Walter Gerschwitz, Moensheim; Güenther Schwerin, Moeglingen, all of Fed. Rep. of Germany

[73] Assignee: Robert Bosch GmbH, Stuttgart, Fed. Rep. of Germany

[21] Appl. No.: 876,216

[22] Filed: Feb. 9, 1978

[51] Int. Cl.[2] ..... F15B 13/04

[52] U.S. Cl. ..... 137/596.13; 91/447; 91/451; 137/596.2

[58] Field of Search ..... 91/447, 451; 137/596.13, 596.2

[56] References Cited

U.S. PATENT DOCUMENTS 3,924,655 12/1975 Schwerin ..... 137/596.13

FOREIGN PATENT DOCUMENTS 1928896 12/1970 Fed. Rep. of Germany ..... 137/596.13

*Primary Examiner*—Gerald A. Michalsky
*Attorney, Agent, or Firm*—Michael J. Striker

[57] ABSTRACT

An arrangement for controlling the flow of a hydraulic fluid between a pump, a user and a fluid reservoir includes a main control slide, an auxiliary control slide accommodated in a compartment provided in one end of the main control slide, a flow-regulating valve arranged in parallel to the main control slide between the pump and the fluid reservoir and a holding valve arranged in a pressure conduit section between the main control slide and the user. The main control slide is shiftably received in a bore which has a plurality of annular chambers arranged therealong. The main control slide has a plurality of lands separated by respective recesses, the lands, depending on the position of the main control slide, establishing or interrupting the communication between the respective chambers. The chambers include a switching chamber which communicates with the flow-regulating valve, an input chamber which communicates with the pump, and a control chamber which is arranged between the switching chamber and the input chamber and communicating with the user through the pressure conduit section. The main control slide has an adjustable throttle which influences the flow of the hydraulic fluid between the input chamber and the control chamber. The main control slide is shiftable between an energizing and a deenergizing position through a neutral position and has a first land which interrupts the communication between the switching and control chambers in the energizing position, and a second land which interrupts such communication in the de-energizing position of the main control slide. The first land is arranged at a region of the main control slide which bounds the compartment accommodating the auxiliary control slide.

8 Claims, 4 Drawing Figures

VALVE ARRANGEMENT FOR CONTROLLING THE FLOW OF HYDRAULIC FLUID TO AND FROM A USER

BACKGROUND OF THE INVENTION

The present invention relates to a hydraulic control arrangement in general, and more particularly to an arrangement for controlling the flow of a hydraulic fluid to and from a hydraulic user.

There are already known various arrangements for controlling the flow of a hydraulic fluid between a fluid reservoir, a pump and a user. Such arrangements usually include a control slide which may be elongated and include a plurality of annular control lands and which is longitudinally shiftably received in a bore of a housing which has a plurality of annular chambers surrounding the bore. Then, as the control slide is being shifted longitudinally thereof between a plurality of displaced positions, the various lands establish and interrupt communication between the various chambers of the housing which, in turn, are in communication with various conduits of a hydraulic circuit interconnecting the user, the pump and the fluid reservoir. When it is desired to gradually rather than abruptly control the communication between the various chambers of the housing accommodating the control slide, it is also already known to provide at least one of the lands with a bevelled control edge which, together with the cooperating control edge of the respective chamber, forms a throttling gap the size of which is adjusted in dependence on the extent of displacement of the control slide.

In one of the conventional arrangements of this type which is revealed in the German Pat. DT-PS No. 1,928,896, a main control slide is used for controlling the communication with the fluid reservoir of a pressure throttle which communicates the pump with the user through an input chamber, the main control slide forming an adjustable throttle which influences the operation of a flow-regulating valve which is arranged in parallel to the main control slide between the pump and the fluid reservoir. This conventional control arrangement includes a control conduit which communicates the flow-regulating valve with a switching chamber the communication of which with the fluid reservoir is controlled by the main control slide. The main control slide has an internal compartment which accommodates an auxiliary control slide of movement in the compartment, the auxiliary control slide controlling the communication of the switching chamber with the fluid reservoir in dependence on the position of the main control slide. The pressure channel of this arrangement also passes through the switching chamber. A fine-adjustment bevelled edge on the main control slide serves to control the flow of the hydraulic fluid to the user proportionally to the displacement of the main control slide, the fine-adjustment bevelled edge controlling the communication between the input chamber and the switching chamber which is located adjacent to the input chamber. The pressure differential between the input and the switching chamber is controlled by a slide of the flow-regulating valve. The fine-adjustment bevelled edge is located at a section of the main control slide in which there is additionally provided a compartment which accommodates the auxiliary control slide which acts as a rapidswitching valve.

As a result of this arrangement of the auxiliary control slide within the main control slide, the amount of available space is drastically limited so that it is impossible to provide a passage of an increased flow-through cross-sectional area adjacent to the fine-adjustment region. As a result of the special arrangement of the flow-regulating valve of this reference, this results in a situation in which the user cannot be supplied with substantial amounts of the hydraulic fluid per unit time, in view of the fact that the available flow-through cross-sectional area acts as a throttle and, as a result of this throttling action, the slide of the flow-regulating valve permits some of the fluid being pumped by the pump to return into the fluid reservoir. While it is true that it is possible to increase the flow rate of the hydraulic fluid from the pump to the user by increasing the pre-tension of a spring which acts on the slide of the flow-regulating valve, the resort to this measure results in an undesired increase in the resistance of the flow-regulating valve to the flow of the hydraulic fluid in the neutral position of the main control slide in which the hydraulic fluid is neither delivered to nor discharged from the user. Under these circumstances all of the output of the hydraulic fluid from the pump is being returned to the fluid reservoir through the flow-regulating valve. It will be appreciated that the above-mentioned increase in the resistance of the flow-regulating valve to the flow of the hydraulic fluid therethrough will result in considerable energy losses.

In addition thereto, this conventional control arrangement has the disadvantage that, in order to avoid a malfunction, the switching chamber is protected by arranging an additional checkvalve in the pressure chamber so as to assure that, in the de-energizing position of the main control slide, no pressurized fluid can flow from the user to the flow-regulating valve and influence the operation thereof. Were it otherwise, the flow-regulating valve could become closed at a time when closing of this valve is undesired. However, because of the need for providing the additional check valve, the control arrangement becomes too expensive in terms of manufacturing costs thereof.

SUMMARY OF THE INVENTION

Accordingly, it is a general object of the present invention to avoid the disadvantages of the prior art.

More particularly, it is an object of the present invention to so construct a control arrangement of the type here under consideration as not to be possessed of the above-mentioned disadvantages of the prior art constructions.

In particular, it is an object of the present invention to render it possible to deliver an arbitrarily high volume of the hydraulic fluid to the user in the energizing position of the main control slide next to a fine-adjustment range thereof.

A further object of the present invention is to so design the arrangement that the spring which acts on the flow-regulating valve may be relatively weak without detrimentally influencing the operation of the control arrangement.

A concomitant object of the present invention is to develop a control arrangement which is simple in construction, inexpensive to manufacture, and reliable in operation nevertheless.

In pursuance of these objects and others which will become apparent hereafter, one feature of the present invention resides, briefly stated, in an arrangement for controlling the flow of a hydraulic fluid between a fluid reservoir, a pump and a user, which arrangement is of the type including a main control slide that controls the communication with the fluid reservoir of a pressure channel which communicates the pump with the user through an input chamber, and that forms an adjustable throttle which influences the operation of a flow-regulating valve which is arranged in parallel to the main control slide between the pump and the fluid reservoir, the arrangement further including a control conduit communicating the flow-regulating valve with a switching chamber the communication of which with the fluid reservoir is controlled by the main control slide, in the improvement wherein a control chamber is arranged at the main control slide between the switching chamber and the input chamber, wherein the pressure channel has a section which communicates the control chamber with the user, and wherein the adjustable throttle is so arranged as to influence the flow of the hydraulic fluid between the input chamber and the control chamber. Advantageously, the main control slide has a control land which interrupts the communication of the switching chamber with the control chamber when the adjustable throttle is fully open.

The control arrangement constructed in this manner according to the present invention is advantageous in that an arbitrarily high amount of the pressurized hydraulic fluid can be delivered to the user in the energizing position of the main control slide after the latter has passed through the fine-adjustment range, inasmuch as the flow-regulating valve is fully closed in this energizing position of the main control slide and, therefore, any return of the hydraulic fluid pumped by the pump into the fluid reservoir is avoided. The spring which controls the displacement of the flow-regulating valve, in cooperation with the influence of the pressurized fluid on the flow-regulating valve, can be made relatively weak so that the flow-regulating valve offers only a minimum resistance to the flow of the hydraulic fluid therethrough in the neutral position of the main control slide which, in turn, results in a reduction of energy losses. Furthermore, the control arrangement of the present invention is relatively simple in construction and can be accommodated in a housing of the same construction as previously used.

The main control slide of the control arrangement of the present invention has an internal compartment and an auxiliary control slide is movably accommodated in the compartment and controls the communication of the switching chamber with the fluid reservoir in dependence of the position of the main control slide. Advantageously, as proposed by the present invention, the control land is arranged at the region of the above-mentioned compartment.

As already mentioned previously, the main control slide is displaceable between a first position in which the user is being energized and a second position in which the user is being de-energized through a neutral position and a range of fine-adjustment positions intermediate the neutral and the first positions. Then, in accordance with an aspect of the present invention, the control land is received in the switching chamber when the main control slide assumes the second position, the neutral position and any position within the fine-adjustment range.

According to an additional concept of the present invention, the main control slide has an additional control land which interrupts the communication of the switching chamber with the control chamber in the second position of the main control slide. When the main control slide is constructed in the above-mentioned manner, its operation is especially advantageous inasmuch as the rear side of the slide of the flow-regulating valve is separated from the user in the second position of the main control slide so that the above-mentioned additional check valve can be dispensed with.

In accordance with an additional aspect of the present invention, the control slide has a further control land which forms the adjustable throttle. Then, the additional control land is arranged between the control land and the further control land. The additional control land is so arranged on the main control slide as to be received in the control chamber in the first position of the main control slide and as to interrupt the communication between the control chamber and the switching chamber at least in the second position of the main control slide. It is especially advantageous in the context of the present invention when the main control slide has a control surface which forms the adjustable throttle and an annular groove which is adjacent the control surface and remote from the above-mentioned compartment as considered in the displacement direction of the main control slide. The remote arrangement of the annular groove renders it possible to make it deeper than would be possible if the annular groove were arranged in the region of the compartment, thus making it possible to increase the amount of the hydraulic fluid which will be able to flow through the annular groove without being throttled therein to any appreciable extent.

According to an additional aspect of the present invention, the control arrangement further comprises a holding valve arranged in the above-mentioned section of the pressure conduit, and means for actuating the holding valve. Then, to advantage, an additional control chamber communicating with the actuating means, a return chamber communicating with the fluid reservoir, a working chamber communicating with the above-mentioned section of the pressure conduit, and an end chamber are sequentially arranged adjacent the input chamber and adjacent each other.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DISCUSSION OF THE PREFERRED EMBODIMENTS

Figure 1:
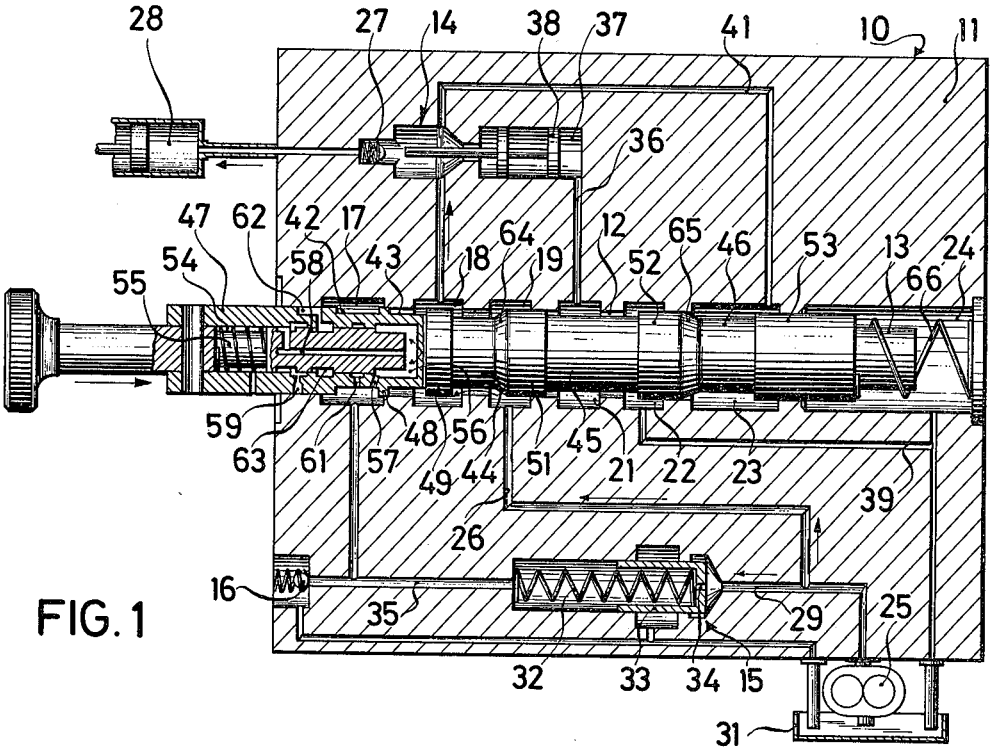
FIG. 1 is a somewhat simplified longitudinal sectional view of a control arrangement according to the present invention in an energizing position thereof.

Referring now to the drawing in detail, and first to FIG. 1 thereof, it may be seen that reference numeral 10 has been used to designate the control arrangement of the present invention in toto. The control arrangement 10 includes a housing 11 which bounds a bore 12. A main control slide 13 is longitudinally shiftably accommodated in the bore 12. Furthermore, a holding valve 14, a flow-regulating valve 15, as well as a pressure-limiting valve 16 cooperating with the flow-regulating valve 15 are arranged in the housing 11.

The housing 11 defines a plurality of annular enlargements around the bore 12 which, in succession, form a switching chamber 17, a first control chamber 18, an input chamber 19, a second control chamber 21, a return chamber 22, a working chamber 23, as well as a second return chamber 24. A pump 25 delivers pressurized hydraulic fluid into a pressure conduit 26 which leads through the input chamber 19 and the first control chamber 18 into the holding valve 14 and from there past a check valve 27 to a user 28 which is diagrammatically illustrated as a cylinder-and-piston unit of the type which is displaced by the hydraulic fluid only in one direction while the displacement thereof in the opposite direction occurs automatically once the pressurized fluid pressure in the user 28 is reduced. The cylinder-and-piston arrangements of this type are used, for instance, in lifting arrangements or the like.

A conduit 29 branches from the pressure conduit 26 upstream of the main control slide 13, leading into a fluid reservoir 31. The flow regulating valve 15 is interposed in the conduit 29. The flow-regulating valve 15 has a slide 33 which is acted upon by a spring 32. A flow-restricting orifice 34 is provided in the slide 33. A control conduit 35 leads from the flow-restricting orifice 34 to the switching chamber 17. In addition thereto the pressure-limiting valve 16 also controls the pressure prevailing in the control conduit 35.

A control channel 36 communicates the second control chamber 21 with a pressure space 37 of an actuating piston 38 which forms a part of the holding valve and is capable of displacing the one-way valve 27 into its open position. A return conduit 39 leads from the return chamber 22 to the fluid reservoir 21, the return conduit also communicating with the second return chamber 24. Furthermore, a relief channel 41 leads from the holding valve 14 into the working chamber 23.

The main control slide 13 is provided with a first to fifth annular groove 42, 43, 44, 45 and 46 which are separated from one another by a first land 47 a first and a second control land 48, 49, as well as a second, third and fourth lands 51, 52, and 53.

In the region of the first and second annular grooves 42 and 43, the main control slide 13 is formed with an internal compartment 54 in which a spring-biased auxiliary control slide 55 is accommodated, the auxiliary control slide 55 acting as a rapid-action switch. The auxiliary control slide 55 delimits a pressure space 56 which is in communication with the switching chamber 17 through a throttling opening 57 arranged in the region of the first annular groove 42. In addition thereto, the pressure space 56 communicates with a first outlet opening 59 in the first land 47 through bores 58 which are provided in the auxiliary control slide 55. Furthermore, an inlet opening 61 is provided in the region of the first inner groove 42 and communicates with the internal compartment 54, and a second outlet opening 62 is provided in the first land 47 and communicates with an annular recess 63 on the auxiliary control slide 55.

Figure 2:
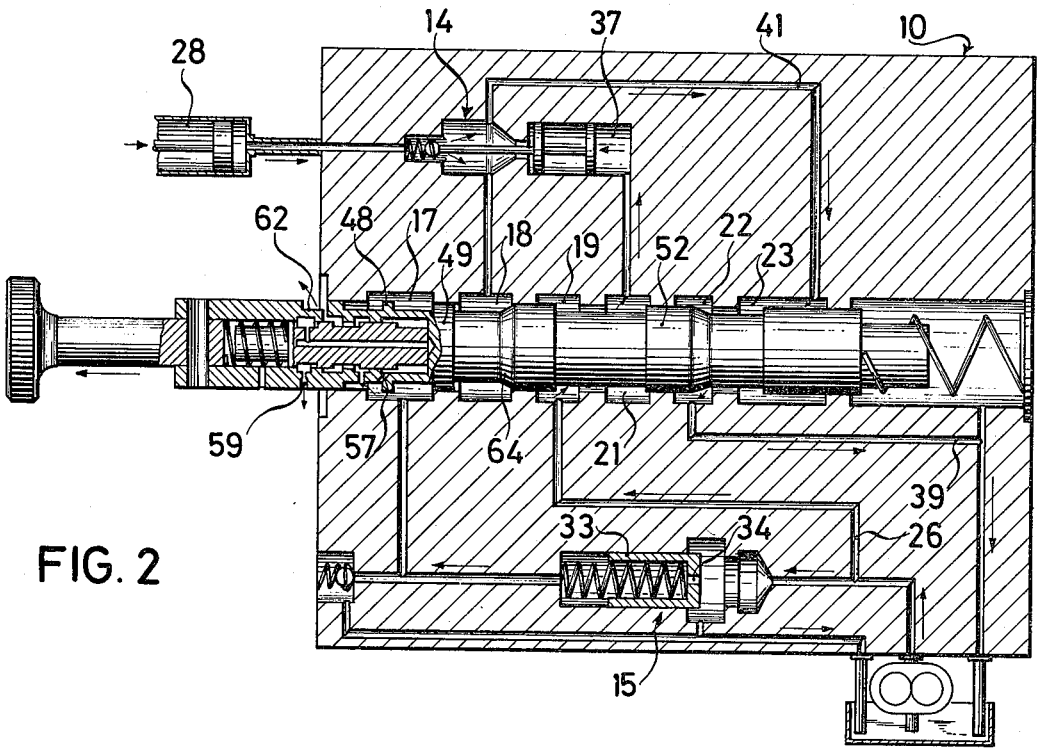
FIG. 2 is a view of the arrangement of FIG. 1 but in a de-energizing position thereof.

The first control land 48 is relatively narrow and serves to interrupt the communication between the switching chamber 17 and the first control chamber 18 when the main control slide 13 assumes the position illustrated in FIG. 1, that is, when it is fully displaced into its energizing position. The second control land 49, which is wider than the first control land 48, controls the same cross-section, but it interrupts the communication therethrough, above all, in the de-energizing position of the main control slide which is illustrated in FIG. 2.

The second land 51 which is arranged adjacent to the second control land 49 is formed with a fine-adjustment bevelled edge 64 which acts as a throttle. The fine-adjustment bevelled edge 64 controls the flow of the hydraulic fluid in dependence on the extent of displacement of the main control slide 13 between a neutral position illustrated in FIG. 3 and the fully energizing position illustrated in FIG. 1. The magnitude of the pressure differential existing across the throttling gap at the bevelled edge 64 is controlled by the slide 33 of the flow-regulating valve 15.

Simultaneously therewith, the second land 51 also controls the communication of the input chamber 19 to the second control chamber 21, so as to render it possible to open the holding valve 14 when it is desired to de-energize the user 28.

The third land 52 controls the relief of the pressure space 37 of the holding valve 14, as well as the relief of the working chamber 23, in the de-energizing position of the main control slide 13. To obtain a gradual pressure relief, the third land 52 is formed with a fine-adjustment bevelled edge 65.

As a result of the position of the third annular groove 44 at a distance from the compartment 54 as considered in the longitudinal direction of the main control slide 13, the annular groove 44 can be made relatively deeper than the first and the second annular grooves 42 and 43 so that a large flow-through cross-sectional area is available at this location.

The main control slide 13 is biased by a spring 66 in the leftward direction as illustrated in the drawings. The free end of the main control slide 13 which projects beyond the housing 11 and which adjoins the first land 47 may be connected to a control linkage, for instance of an agricultural implement controlling device, such as that revealed in the German Pat. DT-PS No. 1,928,896.

Having so discussed the construction of the control arrangement 10 of the present invention, the operation thereof will now be explained.

Figure 3:
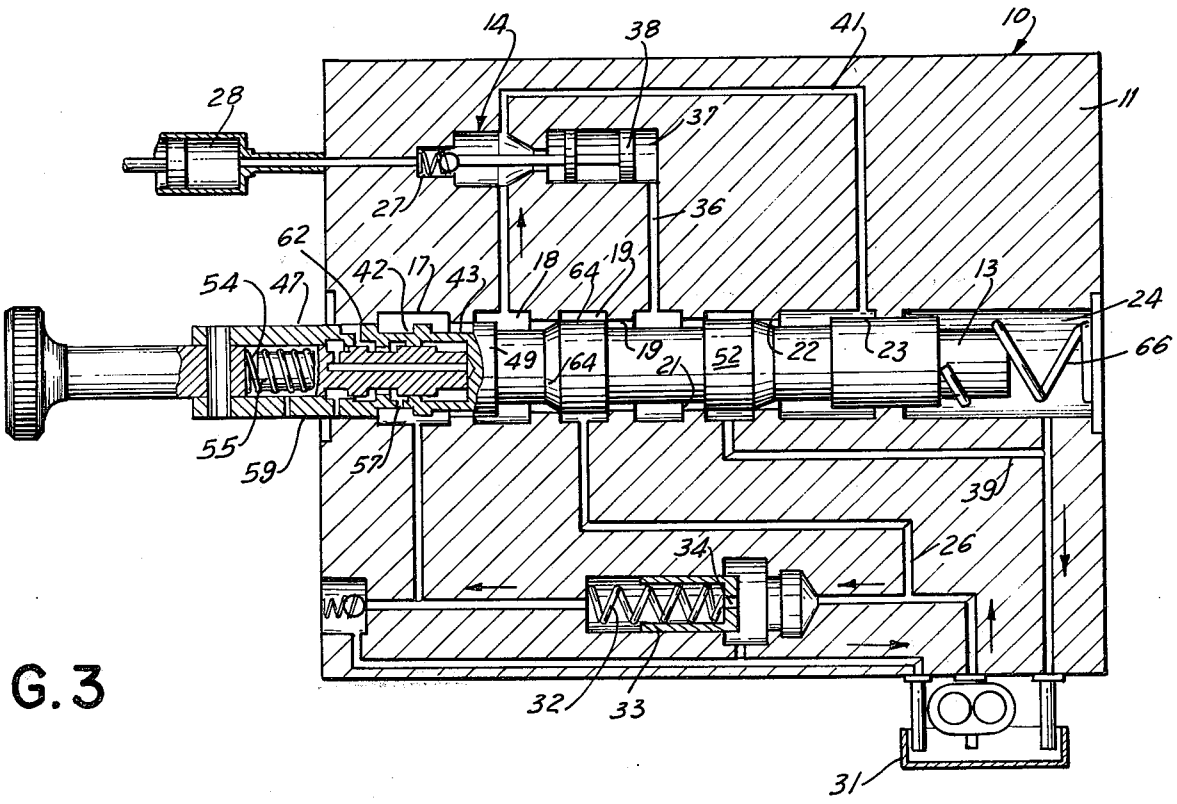
FIG. 3 is a view similar to FIGS. 1 and 2 but in a neutral position.

When the main control slide 13 assumes its neutral position which is illustrated in FIG. 3, the input chamber 18 is blocked by the second control land 49 as well as by the second land 51, and the user 28 is additionally secured by the one-way valve 27. Simultaneously therewith, the auxiliary control valve assumes the illustrated position inasmuch as the first as well as the second outlet openings 59 and 62 are located outside the housing 11 and, therefore, they communicate with the fluid reservoir 31. As a result of this, even the pressure space 56 delimited by the auxiliary control slide 55 is in communication with the fluid reservoir 31 so that the control quantity of the hydraulic fluid which flows from the switching chamber 17 through the throttle opening 57 into the pressure space 56 cannot build up the pressure existing in the pressure space 56, so that auxiliary control slide 55 is held in this illustrated position by the force of its spring.

The control fluid which flows from the pump 25 through the flow-restricting orifice 34 in the flow-regulating valve 15 and through the control conduit 35 into the switching chamber 17, in addition thereto, flows through the inlet opening 61, the annular recess 63 in the auxiliary control slide 55 and the second outlet opening 62 to the exterior of the housing 11 and thus to the fluid reservoir 31. As a result of this, the pressure differential across the flow-restricting orifice 34 causes the slide 33 to open against the force of its spring 32, as a result of which the predominant part of the hydraulic fluid which is being pumped by the pump 25 flows, almost unimpeded, through the conduit 29 to the fluid reservoir 31. Under these circumstances, the spring 32 can be made very weak so as to keep the energy losses to a minimum. Now, when the main control slide 13 is displaced from its neutral position illustrated in FIG. 3 toward but not fully into the position illustrated in FIG. 1, the relief of the control conduit 35 is discontinued inasmuch as the first and second outlet openings 59 and 62 present on the first land 47 become closed. The abrupt closing of the first outlet opening 59 renders it possible for the control quantity of the hydraulic fluid to build up the pressure in the pressure space 56, as influenced by the throttling action of the throttling opening 67, as a result of which the auxiliary control slide 55 is displaced against the force of its spring into its leftward terminal position which is illustrated in FIG. 1. As a result of this, even the communication between the inlet opening 61 and the second outlet opening 62 is interrupted. Simultaneously therewith, the fine-adjustment bevelled edge 64 controls the size of a throttling gap which is interposed in the pressure channel 26. Under these circumstances, the first control land 48 does not interrupt the communication between the switching chamber 17 and the first control chamber 18. As a result of this, the pressure upstream and downstream of the fine-adjustment bevelled edge 64 can act on the two sides of the slide 33 throughout the entire fine-adjustment range. As a result of this, the pressure differential which exists across the fine-adjustment bevelled edge 64 is superimposed with the force of the spring 32. Thus, a stream of the hydraulic fluid flows through the pressure channel 26 to the user 28 in proportion to the degree of displacement of the main control slide 13, independently of the load acting on the user 28, while excess hydraulic fluid, which is not required for energizing the user 28, is shunted by the slide 33 immediately into the fluid reservoir 21. When the main control slide 13 is fully displaced into its energizing position illustrated in FIG. 1, the first control land 48 interrupts the communication of the switching chamber 17 with the first control chamber 18. Under these circumstances, no hydraulic fluid can flow through the flow-restricting orifice 34, through the control conduit 35 and switching chamber 17 to the first control chamber 18 any longer, as a result of which the spring 32 displaces the slide 33, on which the same pressure acts from both sides, into its closing position. The entire output of hydraulic fluid of the pump 25 now flows through the pressure channel 26 to the user 28, while the relatively deep annular groove 44 makes available a large flow-through cross-sectional area, particularly in view of the fact that the fine-adjustment bevelled edge 64 is no longer active in this position of the main control slide 13. As a result of this, the user 28 can be supplied with the entire available output of the pump 25 in the fully energizing position illustrated in FIG. 1 of the main control slide 13. On the other hand, intermediate the positions of the main control slide 13 which are illustrated in FIGS. 1 and 3, the user 28 can be supplied with the hydraulic fluid at a constant rate which is proportionate to the extent of displacement of the main control slide and independent of the load to which the user 28 is subjected, while the energy losses attributable to the action of the slide 33 are still kept to a minimum.

When it is desired to de-energize the user 28, the main control slide 13 is displaced into the position illustrated in FIG. 2. When this happens, the outlet openings 59, 62 in the first land 47 become opened so that the auxiliary control slide 55 assumes the illustrated, rightward terminal position thereof. Thus, a control stream of the hydraulic fluid can flow through the flow-restricting orifice 34 and the control conduit 35 into the switching chamber 17 and from there through the compartment 54 and past the auxiliary control slide 55 to the outlet openings 59 and 62 and thus back into the fluid reservoir 31. As a consequence thereof, the slide 33 is displaced into its fully open position and establishes unimpeded communication of the pump 25 to the fluid reservoir 21. The pressure which still exists in the pressure conduit 26 is transmitted through the input chamber 19, the second control chamber 21 and the control channel 36 into the pressure space 37 of the holding valve 14 and is sufficient to displace the piston 38 of the actuating arrangement so that the latter opens the one-way valve 27. The hydraulic fluid which flows out of the user 28 is conducted through the relief channel 41, the working chamber 23, the fine-adjustment bevelled edge 65 and into the return conduit 39. The reason for providing the fine-adjustment bevelled edge 65 is that it renders it possible to finely control the de-energization of the user 28 within a certain region. Simultaneously therewith, the second control land 49 interrupts the communication between the first control chamber 18 and switching chamber 17 in this region of de-energization so that no pressurized hydraulic fluid can flow from the user 28 to the spring-biased side of the slide 33 during the de-energization and thus the function of the slide 33 cannot be deliteriously influenced.

It will be understood that each of the elements described above, or two or more together, may also find a useful application in other types of constructions differing from the types described above.

While the invention has been illustrated and described as embodied in a control arrangement for use in conjunction with a user that is energized by the hydraulic fluid only in one direction, it is not intended to be limited to the details shown, since various modifications and structural changes may be made without departing in any way from the spirit of the present invention. So, for instance, even the first control land 48 could be formed with a fine-adjustment bevelled edge. Furthermore, even the fine-adjustment bevelled edge 64 and the transition to the annular groove 44 could be configurated differently than illustrated.

Without further analysis, the foregoing will so fully reveal the gist of the present invention that others can, by applying current knowledge, readily adapt it for various applications without omitting features that, from the stendpoint of prior art, fairly constitute essential characteristics of the generic or specific aspects of this invention.

What is claimed as new and desired to be protected by Letters Patent is set forth in the appended claims:

1. In an arrangement for controlling the flow of a hydraulic fluid between a fluid reservoir, a pump and a user, which arrangement is of the type including a main control slide that controls the communication with the fluid reservoir of a pressure chamber which communicates the pump with the user through an input chamber, and that forms an adjustable throttle which influences the operation of a flow-regulating valve which is arranged in parallel to the main control slide between the pump and the fluid reservoir, the arrangement further including a control conduit communicating the flow-regulating valve with a switching chamber the communication of which with the fluid reservoir is controlled by the main control slide, the improvement wherein a control chamber is arranged at the main control slide between the switching chamber and the input chamber, and the main control slide has a control land which interrupts the communication of the switching chamber with the control chamber when the adjustable throttle is fully open; and wherein the adjustable throttle is so arranged as to influence the flow of the hydraulic fluid between the input chamber and the control chamber.

2. The improvement as defined in claim 1, wherein the main control slide has an internal compartment; further comprising an auxiliary control slide movably accommodated in the compartment and controlling the communication of the switching chamber with the fluid reservoir in dependence on the position of the main control slide; and wherein the control land is arranged at the region of the compartment.

3. The improvement as defined in claim 1, wherein the main control slide is displaceable between a first position in which the user is being energized and a second position in which the user is being deenergized through a neutral position and a range of fine-adjustment positions intermediate the neutral and the first positions; and wherein the control land is received in the switching chamber when the main control slide assumes the second position, the neutral position, and any position within the fine-adjustment range.

4. The improvement as defined in claim 1, wherein the main control slide is displaceable between a first position in which the user is being energized and a second position in which the user is being deenergized; and wherein the main control slide has an additional control land which interrupts the communication of the switching chamber with the control chamber in the second position of the main control slide.

5. The improvement as defined in claim 4, wherein the main control slide has a further control land which forms the adjustable throttle; and wherein the additional control land is arranged between the control land and the further control land.

6. The improvement as defined in claim 4, wherein the additional control land is received in the control chamber in the first position of the main control slide and interrupts the communication between the control chamber and the switching chamber at least in the second position of the main control slide.

7. The improvement as defined in claim 1, wherein the main control slide has an internal compartment; further comprising an auxiliary control slide movably accommodated in the compartment and controlling the communication of the switching chamber with the fluid reservoir in dependence on the position of the main control slide; and wherein the main control slide has a control surface which forms the adjustable throttle and an annular groove adjacent the control surface and remote from the compartment as considered in the displacement direction of the main control slide.

8. The improvement as defined in claim 1, further comprising a holding valve in the section of the pressure conduit and means for actuating the holding valve; and wherein an additional control chamber communicating with the actuating means, a return chamber communicating with the fluid reservoir, a working chamber communicating with the section of the pressure conduit and an end chamber are in sequence arranged adjacent the input chamber and adjacent each other.

* * * * *